US009499316B2

(12) United States Patent
Hasegawa

(10) Patent No.: US 9,499,316 B2
(45) Date of Patent: Nov. 22, 2016

(54) HYDROGEN ENCAPSULATING CAP FOR BEVERAGE CONTAINER

(71) Applicant: AMG Co., Ltd., Tokyo (JP)

(72) Inventor: Hiroki Hasegawa, Tokyo (JP)

(73) Assignee: AMG CO., LTD., Tokyo (JP)

( * ) Notice: Subject to any disclaimer, the term of this patent is extended or adjusted under 35 U.S.C. 154(b) by 0 days.

(21) Appl. No.: 14/771,744

(22) PCT Filed: Mar. 28, 2014

(86) PCT No.: PCT/JP2014/059159

§ 371 (c)(1),
(2) Date: Aug. 31, 2015

(87) PCT Pub. No.: WO2014/163007

PCT Pub. Date: Oct. 9, 2014

(65) Prior Publication Data

US 2016/0009466 A1 Jan. 14, 2016

(30) Foreign Application Priority Data

Apr. 4, 2013 (JP) ..... 2013-078979

(51) Int. Cl.
*B65D 51/28* (2006.01)
*B65D 41/32* (2006.01)
(Continued)

(52) U.S. Cl.
CPC ..... *B65D 51/2821* (2013.01); *B65D 41/325* (2013.01); *B65D 41/3419* (2013.01); *B65D 41/505* (2013.01)

(58) Field of Classification Search
CPC .... B65D 41/50; B65D 41/505; B65D 51/28; B65D 51/285; B65D 51/2835; B65D 51/2814
USPC ..... 206/219, 220, 222; 220/212, 526, 523, 220/712; 215/DIG. 8
See application file for complete search history.

(56) References Cited

U.S. PATENT DOCUMENTS 6,152,296 A * 11/2000 Shih ..... B65D 51/2835 206/222
6,170,654 B1 * 1/2001 Gartner ..... B65D 51/2828 206/219

(Continued)

FOREIGN PATENT DOCUMENTS

| | | | |
|---|---|---|---|
| JP | 1132571 | U | 9/1989 |
| JP | 2004299760 | A | 10/2004 |
| JP | 2008513312 | A | 5/2008 |
| JP | 3156674 | U | 12/2009 |

(Continued)

OTHER PUBLICATIONS

International Search Report, PCT/JP2014/059159, Japanese Patent Office, Jun. 4, 2014.

*Primary Examiner* — King M Chu
(74) *Attorney, Agent, or Firm* — Fulwider Patton LLP

(57) ABSTRACT

[Problems to be Solved the Invention]
To provide a hydrogen encapsulating cap for a beverage container, which can improve water-tightness, while preventing increase in the cost for producing a body of the cap.
[Means for Solving the Problem]
There is provided a hydrogen encapsulating cap 3 including a cylindrical cap body 10 formed with a female screw portion 12 for mating with a male screw portion 1*b* of a beverage container mouth 1*a*, a hydrogen encapsulating bag 30 accommodated in the cylindrical cap body 10, a press member 20 for rupturing the hydrogen encapsulating bag 30 by pressing from the above and a downward movement regulating plate 13 disposed in the lower portion of the cylindrical cap body 10 and above the female screw portion 12, and the downward movement regulating plate 13 is formed with a water-tight piece contacting the upper end surface of the beverage container mouth 1*a* and a passage opening through which hydrogen discharged from the hydrogen encapsulating bag 30 can pass.

11 Claims, 14 Drawing Sheets

(51) Int. Cl.
*B65D 41/34* (2006.01)
*B65D 41/50* (2006.01)

(56) References Cited

U.S. PATENT DOCUMENTS 6,935,493 B2 * 8/2005 Cho ..... B65D 51/2835 206/222
8,152,017 B2 * 4/2012 Lizerbram ..... B65D 47/243 206/219
2007/0280042 A1 * 12/2007 Yamanaka ..... B65D 51/2821 366/185
2010/0258457 A1 10/2010 Seelhofer

FOREIGN PATENT DOCUMENTS

JP 2011087547 A 5/2011
WO 2009057940 A1 5/2009
WO 2014021416 A1 2/2014
WO 2014163007 A1 10/2014

* cited by examiner

HYDROGEN ENCAPSULATING CAP FOR BEVERAGE CONTAINER

CROSS-REFERENCES TO RELATED APPLICATIONS

This application is a national stage application based on International Application No. PCT/JP2014/059159 filed Mar. 28, 2014.

FIELD OF THE INVENTION

The present invention relates to a cap for a beverage container such as a PET bottle and in particular, to a hydrogen encapsulating cap for a beverage container in which hydrogen is encapsulated.

BACKGROUND OF THE INVENTION

At present, water, tea, juice and the like (collectively referred to as "beverage" in this specification) in which hydrogen is dissolved are provided in various forms. A beverage in which hydrogen is dissolved is thought to be able to reduce active oxygen harmful to health and eliminate it. The beverage is supplied and sold in the form of an aluminum can containing the beverage in which hydrogen is directly encapsulated, a PET bottle containing the beverage and having a cap in which hydrogen is encapsulated as disclosed in a patent publication No. 1 or the like.

The method disclosed in the patent publication No. 1 is constituted so that consumers themselves dissolve hydrogen encapsulated in the cap into the beverage prior to drinking it.

On the other hand, in the first-mentioned method, since the beverage manufacturer dissolved hydrogen into the beverage, it took a long time for the beverage to reach the consumers. Therefore, PET bottles through which hydrogen can permeate could not be employed as the beverage container and the cost of the beverage container inevitably became high. In addition, the consumers could not be offered a wider range of choices about the kind of beverage contained in the container.

To the contrary, in the method disclosed in Patent publication No. 1, the consumer of the beverage can dissolve hydrogen into the beverage contained in the commercially available PET bottle and it is not necessary for the beverage manufacturer to use a special container. Thus, increase in the cost of the beverage bottle can be prevented and it is possible for the consumer to dissolve hydrogen into the various existing beverages, so that narrowing of consumers' choice of the beverage type can be prevented.

PRIOR ART PUBLICATION

Patent Publication

PATENT PUBLICATION No. 1

Japanese Registered Utility Model Publication No. 3156674

SUMMARY OF THE INVENTION

Problems to be Solved by the Invention

However, in the beverage bottle disclosed in Patent publication No. 1, since it is necessary to encapsulate hydrogen in the body of the cap, the cost for producing the body of the cap becomes higher because the airtightness of the body of the cap needs to be maintained for a long time.

Further, in the case where there is no packing member for maintaining the water-tightness in the cap for encapsulating hydrogen, when the beverage container is shaken in order to dissolve hydrogen into the beverage, there is some risk of the beverage leaking from the beverage container.

It is therefore an object of the present invention to provide a hydrogen encapsulating cap for a beverage container, which can improve water-tightness, while preventing increase in cost for producing a body of the cap.

It is another object of the present invention to provide a beverage contained in a beverage container provided with a hydrogen encapsulating cap which can improve water-tightness, while preventing increased cost for producing a body of the cap.

Means for Solving the Problems

The above object of the present invention can be accomplished by a hydrogen encapsulating cap for a beverage container comprising:

- a cylindrical cap body provided with a female screw portion fitted onto a male screw portion of a beverage container mouth;
- a hydrogen encapsulating bag accommodated in the cylindrical cap body;
- a press member for pushing the hydrogen encapsulating bag from the above; and
- a downward movement regulating plate provided below the cylindrical cap body and above the female screw portion;
- wherein the downward movement regulating plate is provided with a watertight piece in contact with an upper end surface of the beverage container mouth and a passage opening through which hydrogen discharged from the hydrogen encapsulating bag can pass.

According to the present invention, since the hydrogen encapsulating bag is accommodated inside of the cylindrical cap body, it becomes unnecessary to process the cylindrical cap body so as to prevent gas from passing through it and make the cylindrical cap body of a material through which gas cannot pass and therefore, increase in the cost for manufacturing the hydrogen encapsulating cap can be prevented.

Further, according to the present invention, since the hydrogen encapsulating cap is provided with the press member for pushing the hydrogen encapsulating bag from the above, it is unnecessary to press the hydrogen encapsulating bag using screws of the beverage container and deform the cylindrical cap body to press the hydrogen encapsulating bag and it is therefore possible to appropriately press the hydrogen encapsulating bag.

Furthermore, according to the present invention, since the downward movement regulating plate is provided with the watertight piece in contact with an upper end surface of the beverage container mouth, the inside and the outside of the cylindrical cap body are shut off by the screw to make the inside of the cylindrical cap body to be watertight and, therefore, even if the consumer turns the beverage container upside down or shakes it, it is possible to effectively prevent the beverage from leaking out of the beverage container to the outside.

In a preferred aspect of the present invention, the passage opening is provided at a center portion of the downward movement regulating plate and the downward movement regulating plate is disposed so as to be sloped downwardly toward the passage opening.

According to this preferred aspect of the present invention, since the downward movement regulating plate is disposed so as to slope downward toward the passage opening provided at the center portion thereof, even when the consumer turns the beverage container upside down, it is possible to smoothly return the beverage present contained in the hydrogen encapsulating cap into the beverage container 1.

In a preferred aspect of the present invention, the upper surface of the downward movement regulating plate is formed with a projection which can penetrate through a wall of the hydrogen encapsulating bag.

According to this preferred aspect of the present invention, since the upper surface of the downward movement regulating plate is formed with the projection which can penetrate through the hydrogen encapsulating bag, it is possible for the consumer to perforate the hydrogen encapsulating bag only by lightly pressing the press member and, therefore, hydrogen can be more easily discharged from the hydrogen encapsulating cap toward the beverage.

In a preferred aspect of the present invention, the hydrogen encapsulating cap for the beverage container further includes inner ribs formed on the outer circumferential surface of the press member so as to be concentric therewith and each of the inner ribs is formed with a projection which is directed downwardly and can penetrate through a wall of the hydrogen encapsulating bag.

According to this preferred aspect of the present invention, since the inner ribs are formed on the outer circumferential surface of the press member so as to be concentric therewith and each of the inner ribs is formed with the projection which is directed downwardly and can penetrate through the wall of the hydrogen encapsulating bag, it is possible for the consumer to perforate the hydrogen encapsulating bag merely by lightly pressing the press member and, therefore, hydrogen can be more easily discharged from the hydrogen encapsulating cap toward the beverage.

In a preferred aspect of the present invention, the hydrogen encapsulating cap for a beverage container further includes a belt-like member which is connected to the upper end portion of the cylindrical cap body and covers the outer surface of the press member and a portion connecting the belt-like member and the upper end portion of the cylindrical cap body has a strength lower than that of other portions of the hydrogen encapsulated cap for the beverage container.

According to this preferred aspect of the present invention, since the hydrogen encapsulating cap for the beverage container further includes the belt-like member which is connected to the upper end portion of the cylindrical cap body and covers the outer surface of the press member, the press member cannot be pressed unless the belt-like member is taken off and, therefore, it is possible to reliably prevent discharge of hydrogen from the hydrogen encapsulating bag owing to the press member being pressed during wrapping, transport, storage and the like of the hydrogen encapsulating cap and.

Further, according to this preferred aspect of the present invention, since the strength of the portion connecting the belt-like member and the upper end portion of the cylindrical cap body is lower than that of other portions of the hydrogen encapsulating cap for the beverage container, it is possible for the consumer to easily take off the belt-like member, to enable discharge of hydrogen from the hydrogen encapsulating bag toward the beverage.

In a preferred aspect of the present invention, the portion connecting the belt-like member and the upper end portion of the cylindrical cap body is constituted by a thin wall member.

According to this preferred aspect of the present invention, since the portion connecting the belt-like member and the upper end portion of the cylindrical cap body is constituted by a thin wall member, the consumer can easily and reliably take off the belt-like member along the thin wall member.

Another object of the present invention can be accomplished by a beverage contained in the beverage container sealed by the above described hydrogen encapsulating cap.

The above and other objects and features of the present invention will become apparent from the following description made with reference to the accompanying drawings.

Technical Advantages of the Invention

According to the present invention, it is possible to provide a hydrogen encapsulating cap for a beverage container, which can improve water-tightness, while preventing increase in the cost for producing a body of the cap.

PREFERRED EMBODIMENTS OF THE INVENTION

Hereinafter, preferred embodiments of the present invention will be described in detail below with reference to the accompanying drawings.

In this specification, the "top and bottom" of a cap of a beverage container means the "top and bottom" of a beverage container in an erect condition.

Figure 1:
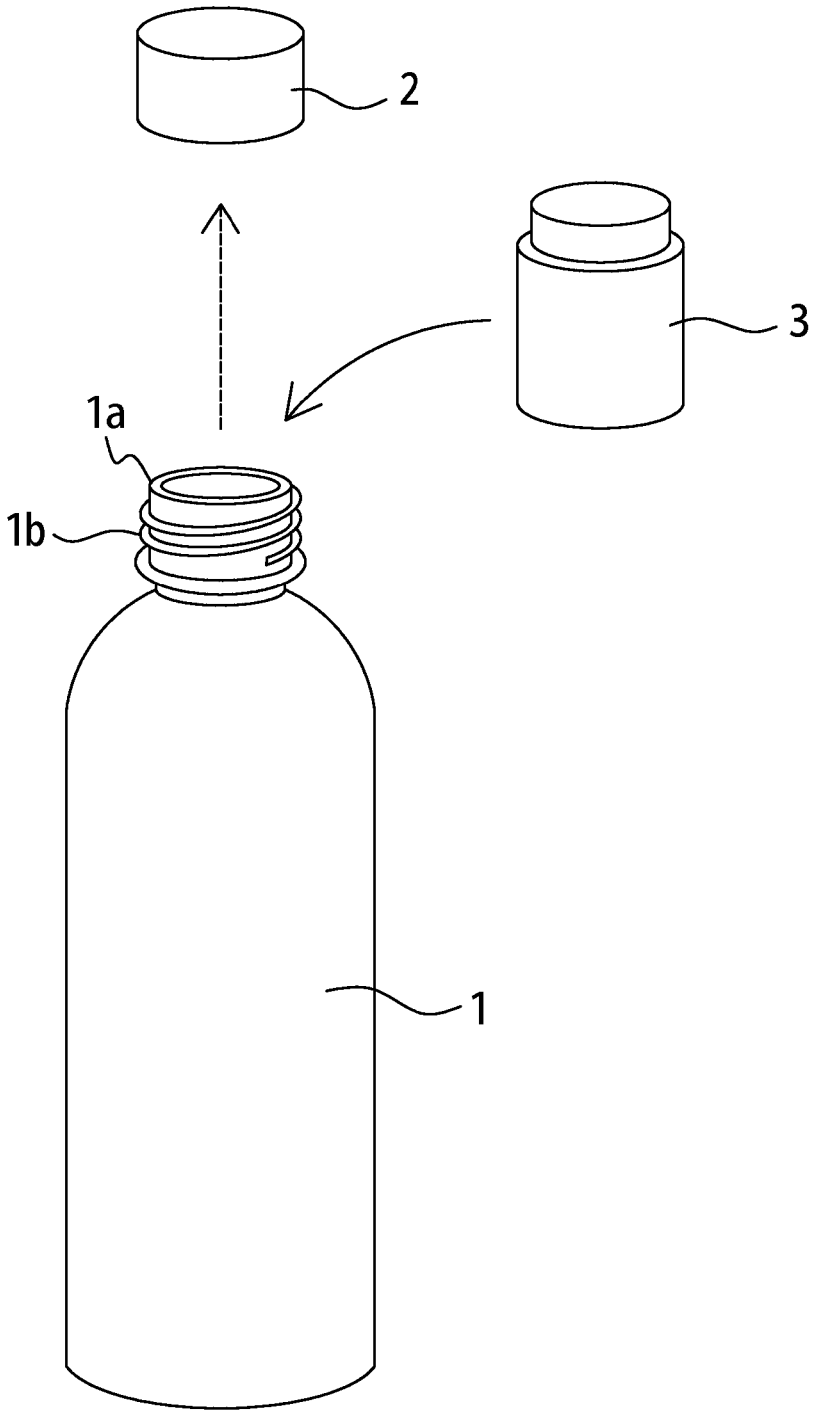
FIG. 1 is a schematic exploded perspective view showing use of a hydrogen encapsulating cap for a beverage container which is a preferred embodiment of the present invention.
Figure 2:
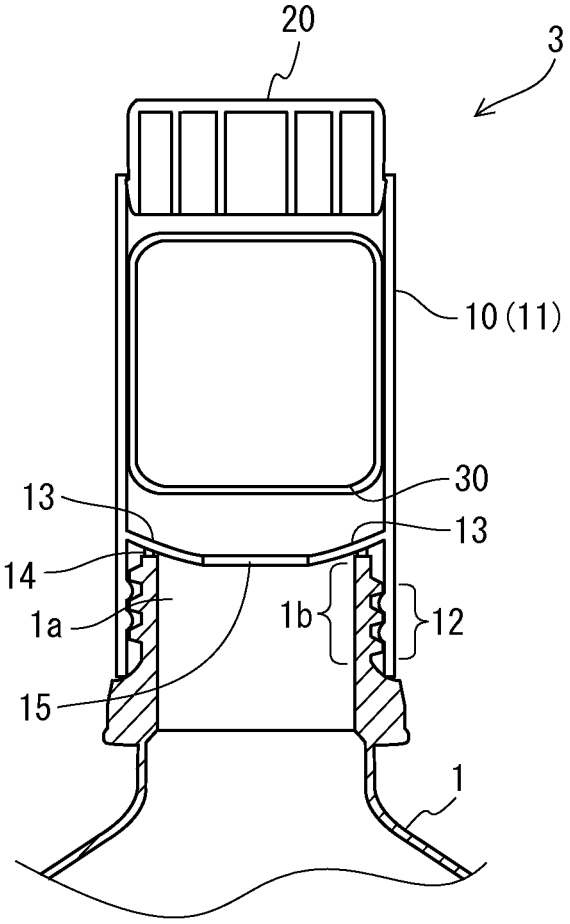
FIG. 2 is a schematic sectional side view of a hydrogen encapsulating cap for a beverage container which is a preferred embodiment of the present invention.

FIG. 1 is schematic exploded perspective view showing use of a hydrogen encapsulating cap for a beverage container which is a preferred embodiment of the present invention and FIG. 2 is a schematic sectional side view of a hydrogen encapsulating bag of a beverage container which is a preferred embodiment of the present invention.

As shown in FIG. 1, when a consumer who purchased a beverage contained in a beverage container 1 provided with a hydrogen encapsulating cap 3 is to drink the beverage, the consumer removes a cap 2 of the beverage container 1. Here, the beverage container 1 is made of a plastic such as polyethylene terephthalate and a typical example of the beverage container 1 is a PET bottle of 500 ml capacity.

As shown in FIGS. 1 and 2, after removing the cap 2, the hydrogen encapsulating cap 3 is mounted on the beverage container 1 using a male screw portion 1*b* formed in a beverage container mouth 1*a* of the beverage container 1.

As shown in FIG. 2, the hydrogen encapsulating cap 3 includes a cylindrical cap body 10 at the lower portion of which a female screw portion 12 is formed to match with the male screw portion 1*a* formed in a beverage container mouth 1*a* of the beverage container 1, a hydrogen encapsulating bag 30 accommodated in the cylindrical cap body 10, and a press member 20 which can press the hydrogen encapsulating bag 30 from the above.

The cylindrical cap body 10 has substantially the same outer diameter as that of the cap 2 of the PET bottle, e.g., an outer diameter of 3 cm, and a height of 6 cm, for example.

The cylindrical cap body 10 includes a cylindrical body 11 formed of rigid plastic and the female screw portion 12 is formed at the lower portion thereof. At a portion of the cylindrical body 11 located above the female screw portion 12, a downward movement regulating plate 13 having a shape similar to bamboo node is provided.

The downward movement regulating plate 13 serves to prevent the hydrogen encapsulating bag 30 from being lowered toward the drink container 1 contrary to a consumer's will and thus prevent it from coming into contact with the beverage container mouth 1*a*.

The lower surface of the downward movement regulating plate 13 is formed with a water-tight piece 14 which contacts the upper end surface of the beverage container mouth 1*a*.

The water-tight piece 14 is formed as a packing and softer than the cylindrical body 11. For example, the water-tight piece 14 is formed of plastic whose hardness is substantially the same as that of a packing (not shown) provided in the cap 2 and when a consumer screws the hydrogen encapsulating bag 30 onto the beverage container 1 and attaches it to the beverage container 1, the water-tight piece 14 comes into contact with the upper end surface of the beverage container 1 and is deformed, thereby maintaining water-tightness on both sides of the water-tight piece 14.

The central portion of the downward movement regulating plate 13 is formed with a passage opening 15 having a diameter of about 1 cm and the inside of the cylindrical cap body 10 in which the hydrogen encapsulating bag 30 and the inside of the beverage container 1 communicate with each other through the passage opening 15. Thus, when hydrogen is discharged from the hydrogen encapsulating bag 30, the discharged hydrogen can be dissolved in the beverage contained in the beverage container 1.

As shown in FIG. 2, the downward movement regulating plate 13 is provided so as to slope downwardly toward the passage opening 15. The inclination angle of the downward movement regulating plate 13 is determined to be 30 degree with respect to the horizontal plane, for example. Since the downward movement regulating plate 13 is provided in this manner, beverage flowing flown from the beverage container 1 through the passage opening 15 to the inside of the cylindrical cap body 10 can be smoothly returned to the inside of the beverage container 1.

As described above, the hydrogen encapsulating bag 30 is accommodated inside the cylindrical cap body 10. In order to prevent hydrogen from permeating through the hydrogen encapsulating bag 30, the hydrogen encapsulating bag 30 is formed of a material obtained by evaporating aluminum onto a plastic film and is constituted so as to encapsulate hydrogen generated by a commercially available hydrogen generator. It is necessary for the inner volume of the hydrogen encapsulating bag 30 to be determined so that all of the hydrogen encapsulated in the hydrogen encapsulating bag 30 can be completely dissolved in the beverage contained in the beverage container 1 and in the case where the inner volume of the beverage container 1 is 500 ml, it is preferable for the inner volume of the hydrogen encapsulating bag 30 to be about 30 ml.

It is preferable for the hydrogen encapsulating bag 30 to be substantially columnar and for the outer diameter of the hydrogen encapsulating bag 30 to be slightly larger than the inner diameter of the cylindrical cap body 10. The hydrogen encapsulating bag 30 is inserted into the cylindrical cap body 10 with the fingers after encapsulating hydrogen in the hydrogen encapsulating bag 30 before insertion of the cylindrical cap body 10.

In this preferred embodiment, the thickness of the hydrogen encapsulated bag 30 is determined in such a manner that a region of the hydrogen encapsulating bag 30 can be broken by pressing the hydrogen encapsulating bag 30 toward the downward movement regulation plate 13 with the press member 20, thereby enabling hydrogen to discharge from the hydrogen encapsulating bag 30. Further, it is possible to form the hydrogen encapsulating bag 30 so that the thickness of only a region thereof is thin and the hydrogen encapsulating bag 30 is broken at this region to discharge hydrogen. In this case, the region to be broken is preferably located in the lower portion of the hydrogen encapsulating bag 30.

The press member 20 is disposed above the cylindrical cap body 10 and it is configured so that the hydrogen encapsulating bag 30 accommodated in the cylindrical cap body 10 can be ruptured when the consumer presses the press member 20. More specifically, the press member 20 is fitted into the cylindrical body 11 of the cylindrical cap body 10 from the above and, after it has been disposed above the cylindrical cap body 10, when the consumer pushes down the press member 20, the press member 20 smoothly moves downwardly while maintaining its attitude to press on the downward movement regulating plate 13. Here, it is necessary to keep the water-tightness between the outer circumferential surface of the press member 20 and the inner circumference of the cylindrical body 11. As shown in FIG. 2, the press member 20 projects upwardly from the upper end portion of the cylindrical cap body 10, whereby the consumer can easily push the press member 20. It is also possible to dispose the press member 20 so that the upper surface thereof is located below the upper end portion of the cylindrical cap body 10 in order to prevent unintended discharge of hydrogen from the hydrogen encapsulating bag 30 by inadvertent pressing of the press member 20 during transport.

Figure 3:
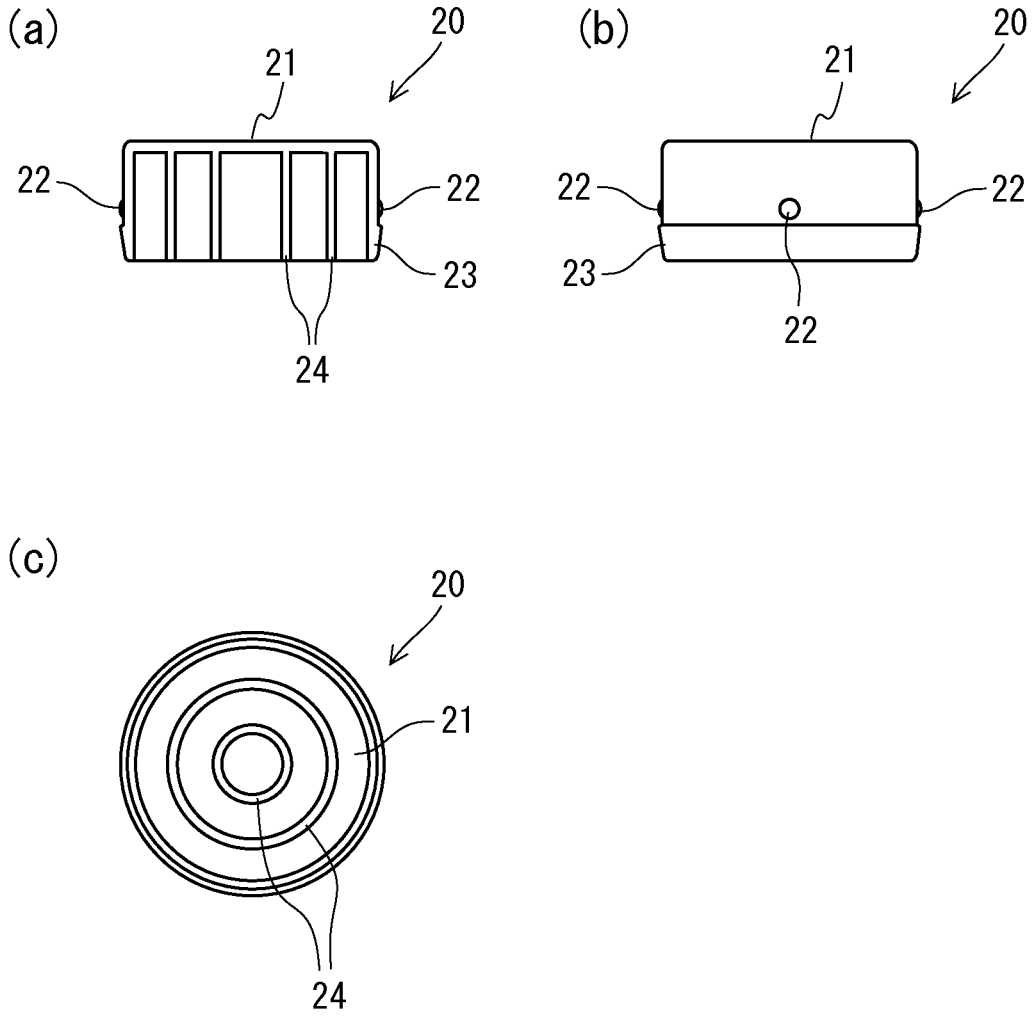
FIG. 3 is a set of views showing the structure of a press member of the hydrogen encapsulating cap for a beverage container which is a preferred embodiment of the present invention, wherein FIG. 3 (*a*) is a schematic longitudinal cross sectional view of the press member, FIG. 3 (*b*) is a schematic side view of the press member and FIG. 3 (*c*) is a schematic bottom view of the press member.

FIG. 3 is a set of views showing the structure of the hydrogen encapsulating bag 30 of the beverage container 1 according to the preferred embodiment of the present invention wherein FIG. 3 (*a*) is a schematic longitudinal view of the press member 20, FIG. (*b*) is a schematic side view of the press member 20 and FIG. (*c*) is a schematic bottom view of the press member 20.

As shown in FIG. 3, the press member 20 is configured so that the press member body 21 having a shape obtained by further flattening the cap 2 of the PET bottle is formed with two ribs 24 concentrically with the outer circumferential surface of the press member body 21, thereby ensuring a desired stiffness.

As shown in FIG. 3, the lower portion of the outer circumferential surface of the press member body 21 is formed with an engaging portion 23, thereby ensuring water-tightness. On the engaging portion 23, four side projections 22 are provided. Each of the side projections 22 serves to prevent the press member 20 from being inserted into the cylindrical cap body 10 too deeply and breaking the hydrogen encapsulating bag 30 when the press member 20 is inserted into the cylindrical cap body 10 in the course of manufacture.

Figure 4:
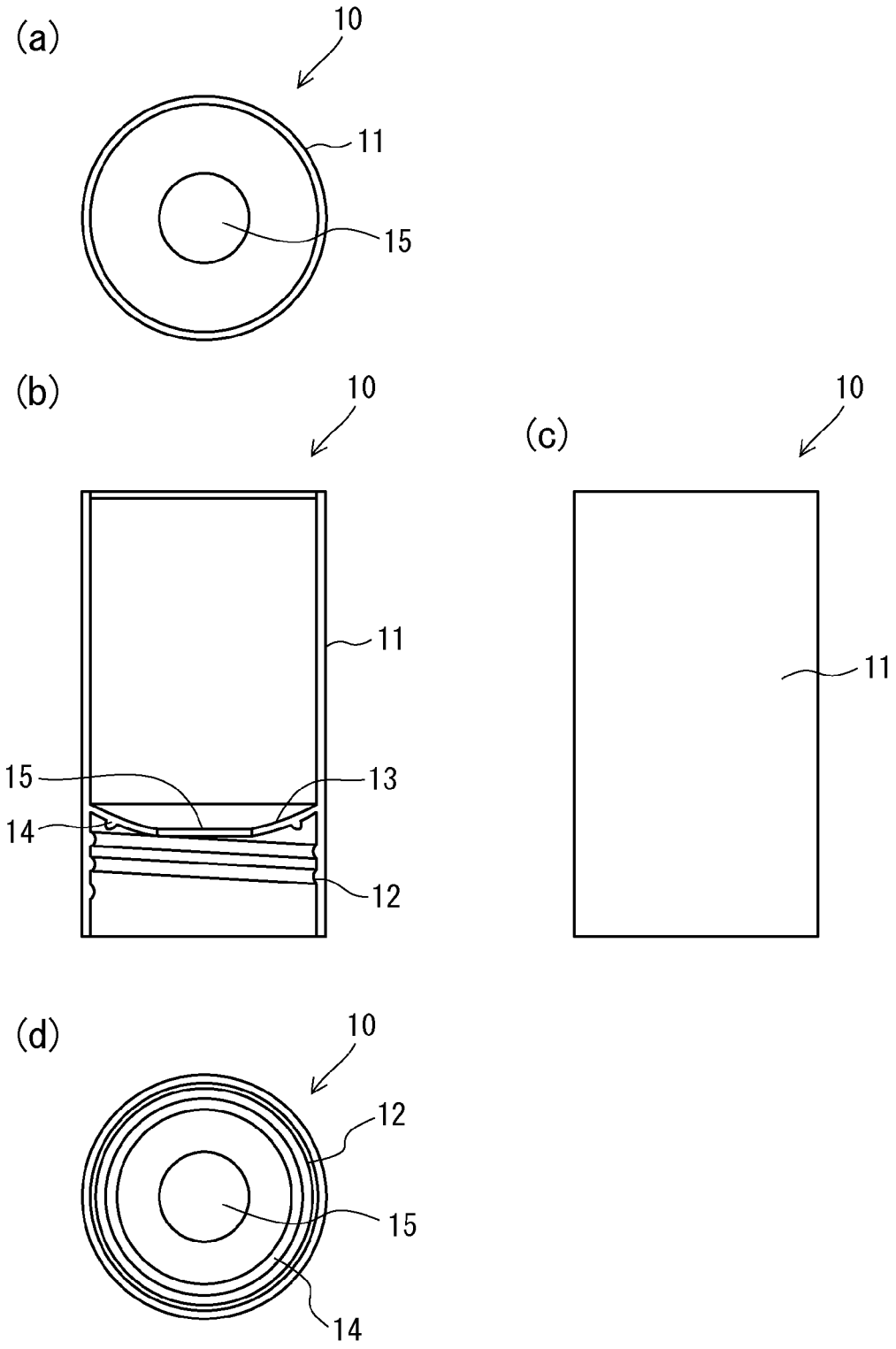
FIG. 4 is a set of views showing the structure of a cylindrical cap body of a hydrogen encapsulating cap for a beverage container which is a preferred embodiment of the present invention, wherein FIG. 4 (*a*) is a schematic view showing a cylindrical cap body, FIG. 4 (*b*) is a schematic longitudinal cross sectional view of a cylindrical cap body, FIG. 4 (*c*) is a schematic side view of a cylindrical cap body and FIG. 4 (*d*) is a schematic bottom view of a cylindrical cap body.

FIG. 4 is a set of views showing the structure of a cylindrical cap body 10 of a hydrogen encapsulating cap 3 for a beverage container 1 which is a preferred embodiment of the present invention, wherein FIG. 4 (*a*) is a schematic view showing a cylindrical cap body 10, FIG. 4 (*b*) is a schematic longitudinal cross sectional view of a cylindrical cap body 10, FIG. 4 (*c*) is a schematic side view of a cylindrical cap body 10 and FIG. 4 (*d*) is a schematic bottom view of a cylindrical cap body 10.

The cylindrical cap body 10 includes the cylindrical body 11, which is provided with the downward movement regulating plate 13 having a shape similar to a bamboo node and a passage opening 15 at the central portion thereof. As shown in FIG. 4, the water-tight piece 14 is provided on the lower surface of the downward movement regulating plate 13 so as to contact the upper end surface of the beverage container mouth 1*a* and serve as a packing.

The thus constituted the hydrogen encapsulating cap 3 which is a preferred embodiment of the present invention is used as follows.

Figure 5:
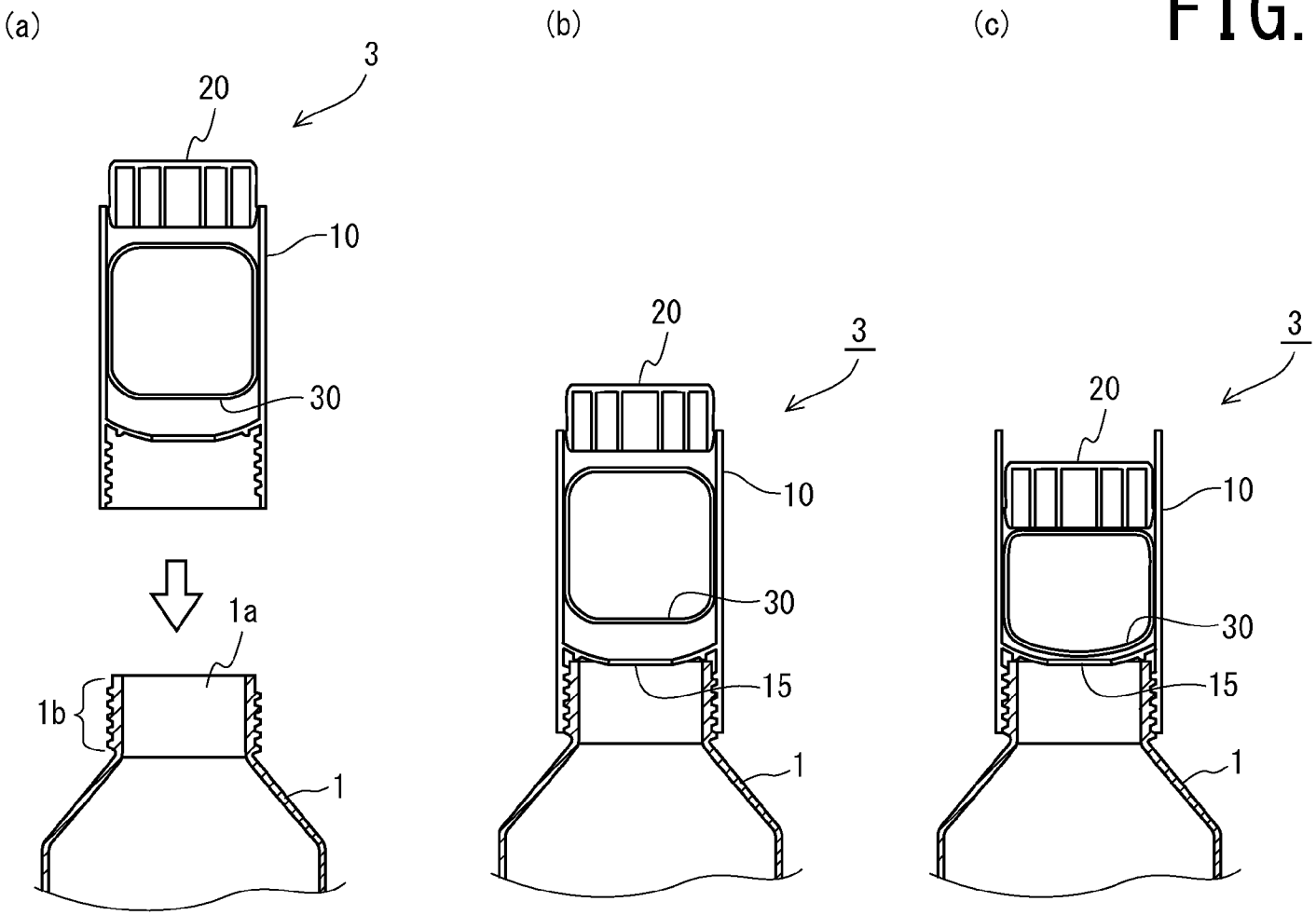
FIG. 5 is a set of schematic longitudinal cross sectional views of a hydrogen encapsulating cap and a beverage container which shows steps of using a hydrogen encapsulating cap, wherein FIG. 5 (*a*) is a schematic longitudinal cross sectional view thereof prior to mounting a hydrogen encapsulating cap on a beverage container, FIG. 5 (*b*) is a schematic longitudinal cross sectional view of a hydrogen encapsulating cap mounted on a beverage water, and FIG. 5 (*c*) is a schematic longitudinal cross sectional view of a hydrogen encapsulating cap and a beverage container when a press member is pressed by a consumer and hydrogen is being discharged from a hydrogen encapsulating bag.

FIG. 5 is a set of schematic longitudinal cross sectional views of the hydrogen encapsulating cap 3 and a beverage container 1 which shows steps of using the hydrogen encapsulating cap 3, wherein FIG. 5 (*a*) is a schematic longitudinal cross sectional view thereof prior to mounting the hydrogen encapsulating cap 3 on the beverage container 1, FIG. 5 (*b*) is a schematic longitudinal cross sectional view of the hydrogen encapsulating cap 3 mounted on the beverage water 1, and FIG. 5 (*c*) is a schematic longitudinal cross sectional view of the hydrogen encapsulating cap 3 and the beverage container 1 when the press member 20 is pressed by the consumer and hydrogen is being discharged from a hydrogen encapsulating bag 30.

First, the beverage container 1 such as a PET bottle having an inner volume of 500 ml and containing beverage, is purchased by the consumer, who then removes the cap 2 of the beverage container 1.

Then, as indicated by an arrow shown in FIG. 5 (*a*), the hydrogen encapsulating cap 3 is mounted on the beverage container mouths of the beverage containers and the like. More specifically, the female screw portion 12 of the encapsulating bag 3 is screwed onto the male screw portion 1*b* of the beverage container mouth 1*a* of the beverage container 1. Here, the pitch of the male screw portion of the beverage container mouths of the beverage containers and the like are slightly different among different manufacturers, and among different beverages, such as water, tea, juice and the like. However, even if the pitch of the female screw portion 12 of the cylindrical cap body 10 and the pitch of the male screw portion 1*b* of the beverage container mouth 1*a* of the beverage container 1 are slightly different, it is nevertheless possible to screw the female screw portion 12 of the cylindrical cap body 10 onto the male screw portion 1*b* of the hydrogen encapsulating bag 3 because the beverage container 1 is made of a plastic such as polyethylene terephthalate.

When the hydrogen encapsulating cap 3 is further screwed onto the drink container mouth 1*a* of the beverage container 1, as shown in FIG. 5 (*b*), the water-tight piece 14 (not shown in FIG. 5 (*b*)) comes into contact with the upper end surface of the beverage container mouth 1*a* and when the hydrogen encapsulating cap 3 is further screwed onto the beverage container mouth 1*a* of the beverage container 1 with a force similar to that used when the cap 2 is closed, the water-tight piece 14 is deformed, whereby the beverage container 1 becomes water-tight. Although the outer diameter and the inner diameter of the beverage containers are slightly different among different beverage manufacturers, and among different beverages, such as water, tea, juice and the like, since the water-tight piece 14 is in contact with the upper end portion of the beverage container mouth 1*a*, the beverage container 1 can easily be made water-tight.

Once the water-tight piece 14 of the hydrogen encapsulating cap 3 has come into contact with the upper end portion of the beverage container mouth 1*a* in this manner, the consumer pushes down the press member 20 of the hydrogen encapsulating cap 3, whereby the hydrogen encapsulating bag 30 is pressed toward the downward movement regulating plate 13 of the cylindrical cap body 10. As a result, a region of the hydrogen encapsulating bag 30 is broken, whereby hydrogen discharges from the hydrogen encapsulating bag 30. The amount of hydrogen passing through a portion between the press member 20 and the cylindrical cap body 10 to be discharged to the outside at this time is minimized by the engaging portion 23 formed at the lower portion of the outer circumferential surface of the press member body 21.

Next, the consumer turns the beverage container 1 upside down and/or shakes it to dissolve hydrogen discharged into the beverage container 1 into the beverage. After dissolving hydrogen into the beverage, the consumer removes the hydrogen encapsulating cap 3 from the beverage container 1, in order to drink the beverage in which hydrogen is dissolved. When the hydrogen encapsulating cap 3 is removed from the beverage container 1, beverage cannot remain on the downward movement regulating member 13 because the downward movement regulating member 13 is sloped downwardly toward the passage opening 15. Therefore, the consumer's hands can be prevented from being soiled with beverage remaining in the hydrogen encapsulating cap 3. Since there is a risk of hydrogen dissolved in the beverage fizzed out over time, it is preferable for the consumer to drink the beverage as soon as possible (within about one day at the longest).

The explanation with reference to FIG. 5 was made regarding the case where the hydrogen encapsulating cap 3 is sold separately from the beverage container 1 containing a beverage and the consumer purchases the hydrogen encapsulating cap 3 separately from the beverage container 1 and then mounts it on the beverage container 1. However, in the case where the manufacturer mounts the hydrogen encapsulating cap 3 on the beverage container 1 before shipping and sells it in this condition, the consumer who buys the beverage container 1 can dissolve hydrogen into the beverage merely by pushing the press member 20 after making the purchase.

According to this preferred embodiment of the present invention, since the hydrogen encapsulating bag 30 is accommodated in the cylindrical cap body 10, it is unnecessary to process the cylindrical cap body 10 so that gas cannot penetrate it or to form the cylindrical cap body 10 of a material through which gas cannot penetrate. Thus, the cost of manufacturing the cylindrical cap body can be minimized.

Further, according to this preferred embodiment, since the hydrogen encapsulating cap 3 is provided with the press member 20 which can push down the hydrogen encapsulating bag 30, it is unnecessary to use a screw provided in the beverage container 1 or deform the cylindrical cap body 10 for pressing the hydrogen encapsulating bag 30 and the hydrogen encapsulating bag 30 can be appropriately pressed.

Furthermore, according to this preferred embodiment, since the downward movement regulating plate 13 is formed with the water-tight piece 14 which can come into contact with the upper end portion of the beverage container mouth 1*a*, it is possible to make the beverage container water-tight by the water-tight piece 14. Therefore, even if the consumer turns the beverage container upside down or shakes it for dissolving hydrogen into the beverage in the beverage container 1, it is possible to effectively prevent the beverage in the beverage container 1 from leaking to the outside.

Moreover, according to this preferred embodiment, since the downward movement regulating plate 13 is provided so as to slop downward toward the passage opening 15 formed at the central portion thereof, even when the consumer turns the beverage container 1 upside down, it is possible to smoothly return the beverage present in the hydrogen encapsulating cap 3 into the beverage container 1.

Figure 6:
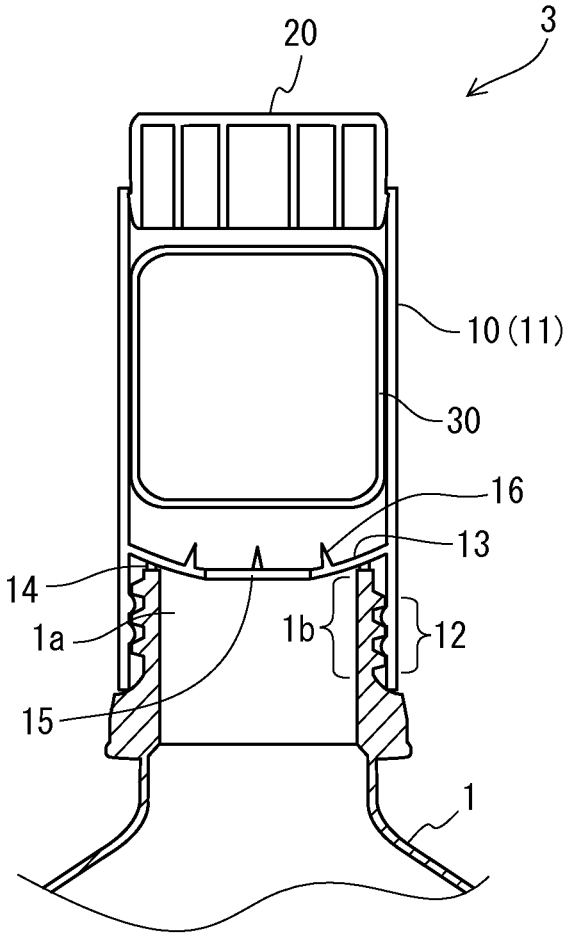
FIG. 6 is a schematic longitudinal view of a hydrogen encapsulating cap which is another preferred embodiment of the present invention.
Figure 9:
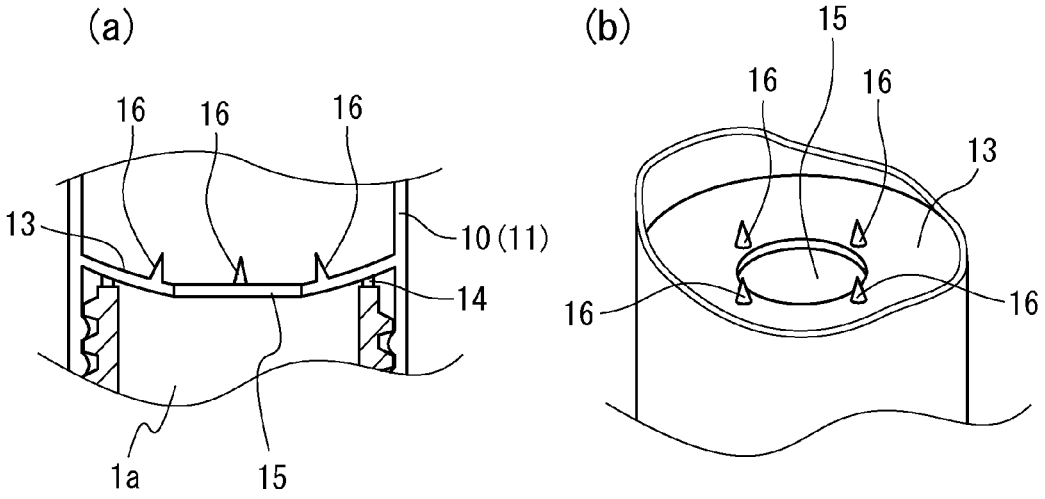
FIG. 9 shows the hydrogen encapsulating cap shown in FIG. 6, which is another preferred embodiment of the present invention, wherein Figure 9(*a*) is a longitudinal cross sectional view thereof and FIG. 9(*b*) is a view showing a downward movement regulating plate viewed obliquely from the upper side.

FIG. 6 is a schematic longitudinal cross sectional view of a hydrogen encapsulating cap which is another preferred embodiment of the present invention and FIG. 9 is a set of views showing details of a downward movement regulating plate of the hydrogen encapsulating cap shown in FIG. 6, wherein FIG. 9 (*a*) is a longitudinal cross sectional view thereof and FIG. 9 (*b*) is a view showing a downward movement regulating plate obliquely viewed from the upper side.

The same components and the same portions as those of the hydrogen encapsulating cap 3 shown in FIGS. 1 to 5 are designated by the same numerals in FIGS. 6 to 9 and explanation about them is omitted.

As shown in FIGS. 6 to 9, in this preferred embodiment, the upper surface of the downward movement regulating plate 13 is formed with projections 16 which can burst through the hydrogen encapsulating bag 30 and the projections are provided at four portions at angular interval of 90 degrees so as to surround the outer circumferential surface of the passage opening 15.

In this preferred embodiment, since the four projections are formed on the upper surface of the downward movement plate 13 in his manner, it is possible to form apertures in the hydrogen encapsulating bag 30 by lightly pushing the press member 20, and it is possible to offer the consumer an easier-to-use the hydrogen encapsulating bag 30 for dissolving hydrogen into beverage contained in the beverage container 1. In the case where the inner volume of the beverage container 1 is large, it is sometimes necessary to increase the thickness of a sheet constituting the hydrogen encapsulating bag 30 so that the pressure of the encapsulated hydrogen can be increased to increase the amount of hydrogen encapsulated in the encapsulating bag 30. However, according to this embodiment, since the four projections 16 are formed on the upper surface of the press member 20, even in such a case, it is possible to form apertures in the hydrogen encapsulating bag 30 in a desired manner to discharging hydrogen.

Figure 7:
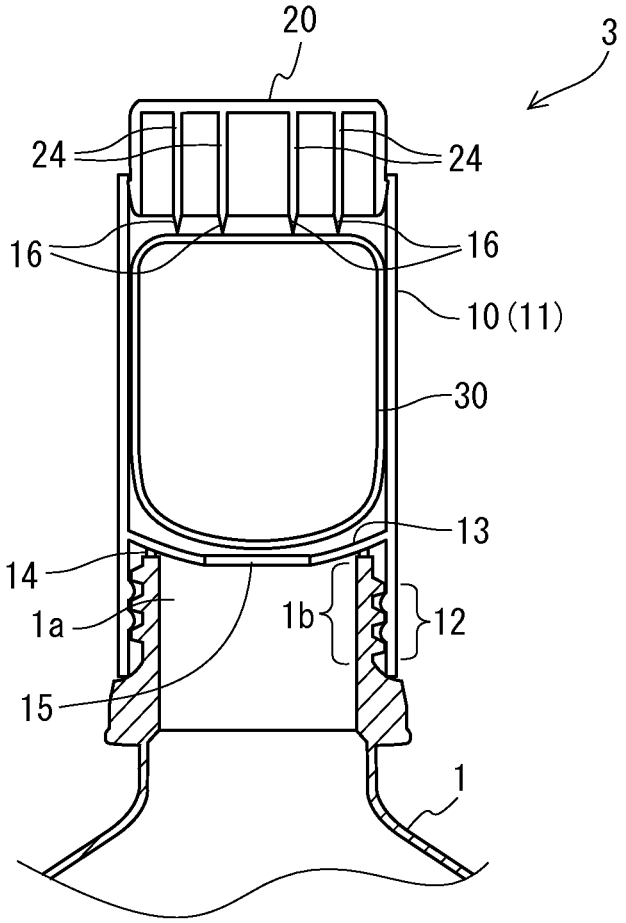
FIG. 7 is a schematic longitudinal view of a hydrogen encapsulating cap which is a further preferred embodiment of the present invention.

FIG. 7 is a schematic longitudinal view of a hydrogen encapsulating cap which is a further preferred embodiment of the present invention.

The same components and the same portions as those of the hydrogen encapsulating cap 3 shown in FIGS. 1 to 5 are designated by the same numerals in FIG. 7 and explanation about them is omitted.

As shown in FIG. 7, in this preferred embodiment, each of the inner ribs 24 of the press member 20 is formed with a projection 16 directed downwardly.

In this preferred embodiment, since each of the inner ribs 24 of the press member 20 is formed with the projection 16 directed downwardly in this manner, it is possible to form apertures in the hydrogen encapsulating bag 30 by lightly pushing the press member 20 and it is possible to offer the consumer an easier-to-use hydrogen encapsulation cap 3 for dissolving hydrogen into the beverage contained in the beverage container 1.

In the case where the inner volume of the beverage container 1 is large, it is sometimes necessary to increase the thickness of a sheet constituting the hydrogen encapsulating bag 30 so that the amount of hydrogen encapsulated in the beverage container 1 can be increased by increasing the inner pressure of hydrogen encapsulated in the beverage container 1. According to this embodiment, since the plurality of projections 16 directed downwardly are formed, even in such a case, it is possible to form apertures in the hydrogen encapsulating bag 30 in a desired manner to emit hydrogen.

Figure 8:
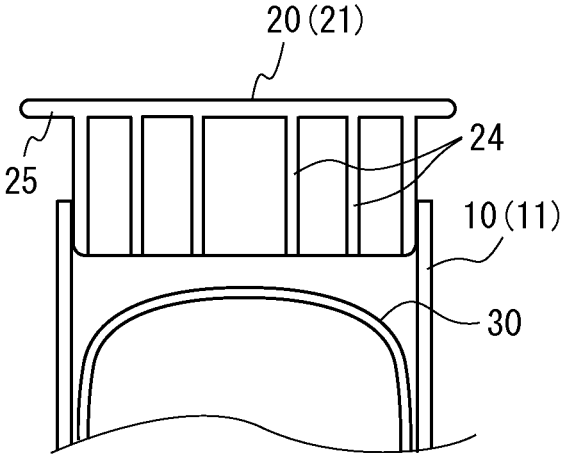
FIG. 8 is a schematic longitudinal view of a hydrogen encapsulating cap which is a still further preferred embodiment of the present invention.

FIG. 8 is a schematic longitudinal view of a hydrogen encapsulating cap which is a still further preferred embodiment of the present invention.

The same components and the same portions as those of the hydrogen encapsulating cap 3 shown in FIGS. 1 to 5 are designated by the same numerals in FIG. 8 and explanation about them is omitted.

As shown in FIG. 8, in this preferred embodiment, the upper surface 25 of the press member body 11 of the press member 10 projects laterally.

Since the upper surface 25 of the press member body 11 of the press member 10 projects laterally in this manner, the consumer can be prevented from pushing the press member 20 into the cylindrical cap body 10 more than necessary. Therefore, the cylindrical cap body 10 and the press member 20 can be used several times by removing the press member 20 from the cylindrical cap body 10, taking out the spent hydrogen encapsulating bag 30 and inserting a hydrogen encapsulating bag 30 newly charged with hydrogen.

Figure 10:
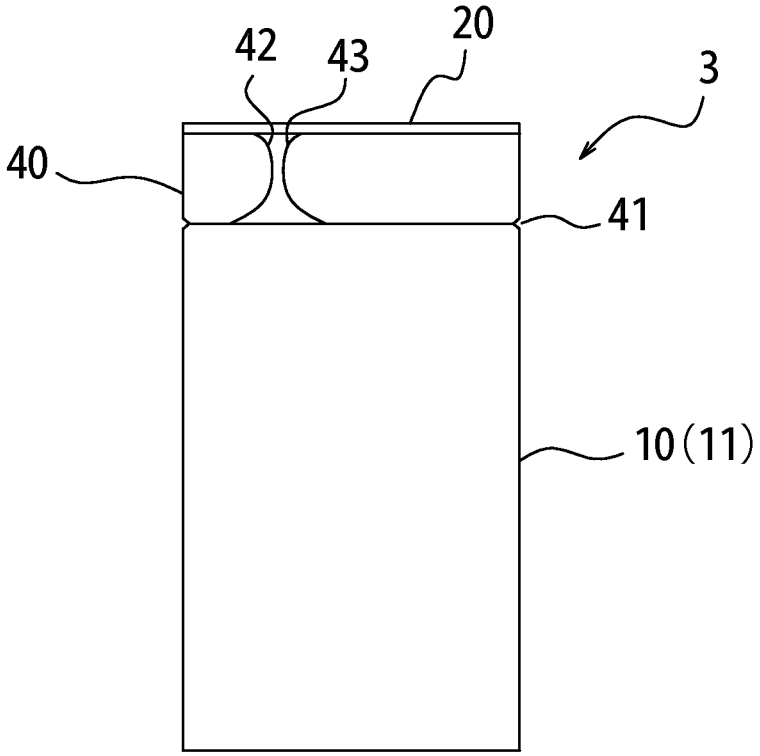
FIG. 10 is a schematic side view of a hydrogen encapsulating cap which is a further preferred embodiment of the present invention.
Figure 11:
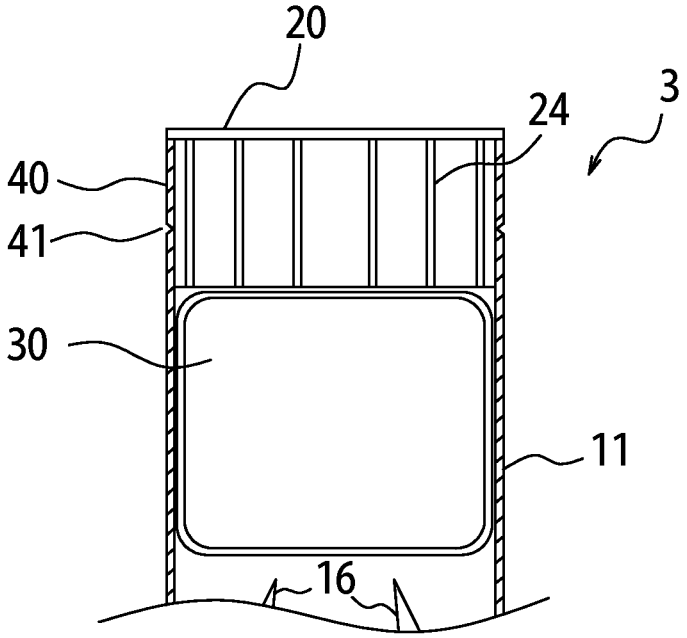
FIG. 11 is a schematic longitudinal view of the hydrogen encapsulating cap shown in FIG. 10.

FIG. 10 is a schematic side view of a hydrogen encapsulating cap which is a further preferred embodiment of the present invention and FIG. 11 is a schematic longitudinal view of the hydrogen encapsulating cap.

As shown in FIGS. 10 and 11, in the hydrogen encapsulating cap 3, a belt-like member 40 is provided around the outer circumferential surface of the press member 20.

As shown in FIG. 11, the belt-like member 40 covers about half of the outer circumferential surface of the press member 20 in the longitudinal (vertical) direction and is connected to the upper end portion of the cylindrical body 11 via a thinned portion 41. Further, the belt-like member 40 does not completely surround the outer circumferential surface of the press member 20 and a gap is formed between the end portions 42 and 43. The two end portions 42 and 43 serve as gripper portions pull tabs to be pulled by the consumer.

In this embodiment, the surface of the belt-like member 40 and the surface of the cylindrical body 11 are flush with each other so that unless the belt-like member 40 is removed from the outer surface of the press member 20, the press member 20 cannot be pushed.

Similarly to the preferred embodiment shown in FIGS. 6 and 9, as shown in FIG. 11, the upper surface of the downward movement regulating plate 13 (not shown in FIG. 11) is formed with projections 16. Although only two projections 16 are shown in FIG. 11, similarly to the preferred embodiment shown in FIGS. 6 and 9, the upper surface of the downward movement regulating plate 13 is formed with four projections in total.

The belt-like member 40 is fixed to the outer circumferential surface of the press member 20 in such a manner that it can be removed from the outer circumferential surface of the press member 20 manually but the press member 20 cannot be pushed during wrapping, transport, storage and the like of the hydrogen encapsulating cap 3.

Therefore, when hydrogen encapsulated in the hydrogen encapsulating cap 3 is to be dissolved into the beverage contained in the beverage container 1, the cap 2 of the beverage container 1 purchased by the consumer such as a PET bottle having an inner volume of 500 ml containing beverage is first removed.

Then, similarly to the arrow shown in FIG. 5 (*a*), the female screw portion 12 of the hydrogen encapsulating cap 3 is screwed onto the male screw portion of cylindrical cap body 10 of the beverage container mouth 1*a* of the beverage container 1 and the hydrogen encapsulating cap 3 is mounted on the beverage container mouth 1*a* of the beverage container 1.

When the hydrogen encapsulating cap 3 is further screwed onto the beverage container mouth 1*a* of the beverage container 1, similarly to in the above described preferred embodiments, the water-tight piece 14 comes into contact with the upper end surface of the beverage container mouth 1*a*. When the hydrogen encapsulating cap 3 is further screwed with ordinary force, the water-tight piece 14 is further deformed and the beverage container 1 is made water-tight by the water-tight piece 14.

Once the water-tight piece 14 of the hydrogen encapsulating cap 3 comes into contact with the upper end surface of the beverage container mouth 1*a* in this manner, the consumer removes the belt-like member 40 by pulling one of the end portions 42 and 43 of the belt-like member 40. Here, since the thinned portion 41 is formed between the belt-like member 40 and the cylindrical body 11, it is possible for the consumer to easily and reliably remove the belt-like member 40 from the outer circumferential surface of the press member 20.

Figure 12:
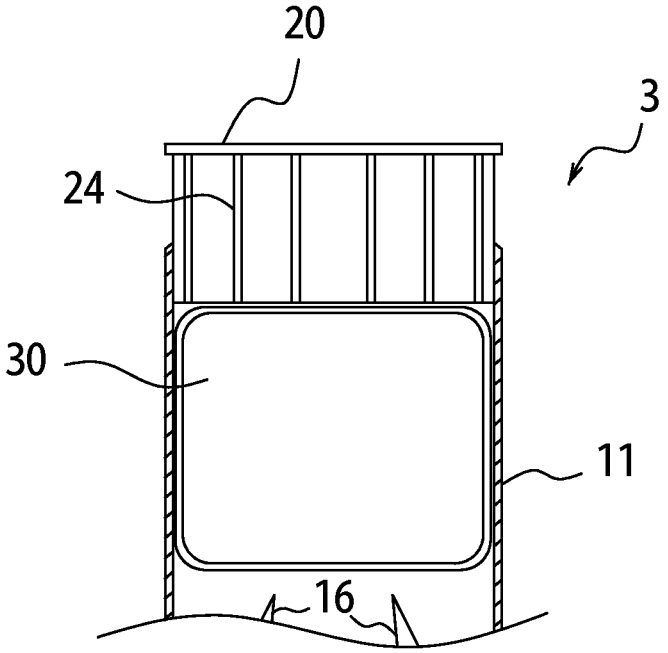
FIG. 12 is a schematic longitudinal view of the hydrogen encapsulating cap shown in FIG. 10 when a belt-like member has been removed.

FIG. 12 is a schematic side view of the hydrogen encapsulating cap 3 after removal of the belt-like member 40.

As shown in FIG. 12, after the belt-like member 40 has been removed from the hydrogen encapsulating cap 3, the press member 20 can be pushed down.

Figure 13:
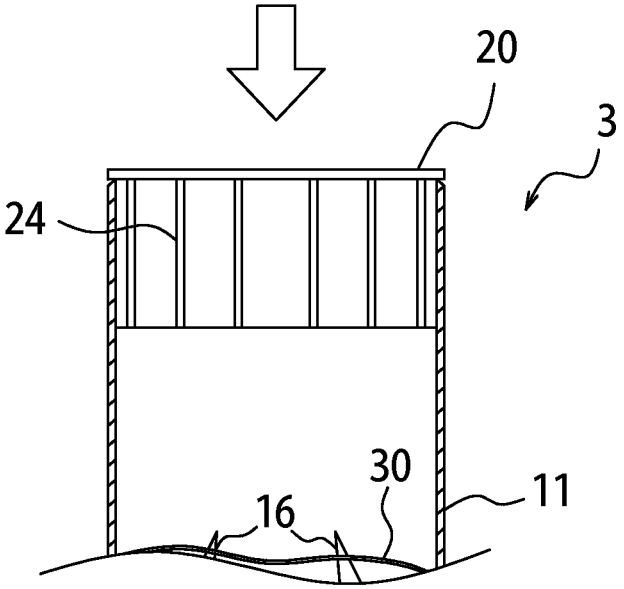
FIG. 13 is a schematic longitudinal view of the hydrogen encapsulating cap shown in FIG. 10 when a press member is being pushed.

FIG. 13 is a schematic side view of the hydrogen encapsulated cap 3 when a press member 20 is being pushed by the consumer.

As shown in FIG. 13, in this embodiment, since the projections 16 capable of breaking the hydrogen encapsulating bag 30 are formed on the upper surface of the downward movement regulating plate 13 at four positions spaced by 90 degrees along the circumference of the passage opening 15, apertures are formed in the hydrogen encapsulating bag 30 by the projections 16 formed on the upper surface of the downward movement regulating plate 13 and hydrogen is discharged from the thus formed apertures through the beverage container mouth 1*a* into the beverage contained in the beverage container 1.

Next, the beverage container 1 is turned upside down and/or shaken by the consumer to dissolve hydrogen discharged into the beverage container 1 into the beverage.

According to this preferred embodiment, the belt-like member 40 is fixed to the outer circumferential surface of the press member 20 so that the press member 20 cannot be pushed unless the belt-like member 40 is removed. Further, the belt-like member 40 is fixed to the outer circumferential surface of the press member 20 in such a manner that the belt-like member 40 can be removed from the outer circumferential surface of the press member 20 manually but the press member 20 cannot be pushed during wrapping, transport, storage and the like of the hydrogen encapsulating cap 3. Therefore, discharge of hydrogen from the hydrogen encapsulating bag 30 owing to the press member 20 being pressed during wrapping, transport, storage and the like of the hydrogen encapsulating cap 3 can be reliably prevented.

Figure 14:
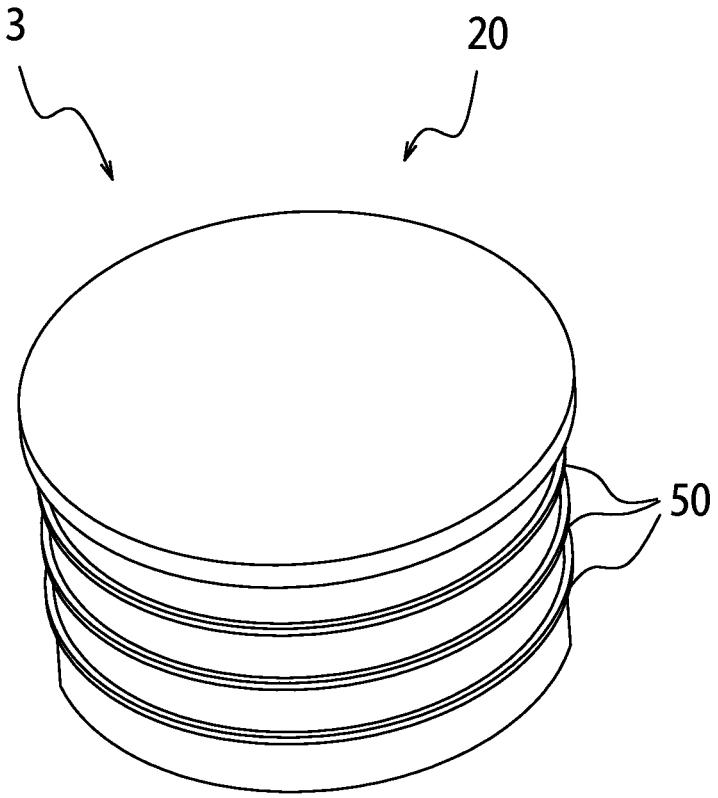
FIG. 14 is a schematic longitudinal view of a press member used for a hydrogen encapsulating cap which is a further preferred embodiment of the present invention.

FIG. 14 is a schematic perspective view of the press member 20 used in a hydrogen encapsulating cap 3 which is a further preferred embodiment of the present invention.

As shown in FIG. 14, in this preferred embodiment, a plurality of annular ribs 50 are formed on the outer circumferential surface of the press member 20. Therefore, the strength of the press member 20 is improved.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, although explanation was made as to the hydrogen encapsulating cap 3 in which hydrogen is encapsulated, aside from the hydrogen, it is also possible to encapsulate a gas such as ozone or liquid to be added to the beverage into a bag in the cylindrical cap body 10.

Further, although a plastic film on which aluminum is evaporated is used as the material for forming the hydrogen encapsulating bag 30 in the above described embodiments, a plastic case can be used instead of the plastic film on which aluminum is evaporated.

Furthermore, although the press member 20 and the cylindrical cap body 10 are constituted as discrete components in the above described embodiments, they can be integrally formed by connecting them with a bellows-like cylinder body. In the case where the press member 20 and the cylindrical cap body 10 are constituted in this manner, when the consumer pushes down the press member 20, the bellows-like cylindrical body is compressed, whereby the hydrogen encapsulating bag 30 is pressed by the lower surface of the press member 20.

Moreover, although the belt-like member 40 is connected to the upper end portion of the cylindrical body 11 via the thinned portion 41 in the embodiments shown in FIGS. 10 to 13, it is possible to integrally form the belt-like member 40 and the cylindrical body 11 and form a portion whose strength is low, for example, a perforation at the position corresponding to the thinned portion 41. Thus, it is not absolutely necessary to connect the belt-like member 40 and the cylindrical body 11 by the thinned portion 41.

Further, although in the embodiments shown in FIGS. 10 to 13, the belt-like member 40 does not completely cover the outer circumferential surface of the press member 20 and the gap is formed between the two end portions 42 and 43 of the belt-like member 40 so that the two end portions 42 and 43 of the belt-like member 40 serve as pull tab to be pinched and pulled by the consumer, it is possible instead to constitute the belt-like member 40 so that it completely covers the outer circumferential surface of the press member 20 and a portion of the belt-like member 40 in the vicinity of the end portion 42 and a portion in the vicinity of the end portion 43 are overlapped with each other so that the upper end portion 42 or 43 among the end portions of the belt-like member 40 serves as a pull tab to be pulled by the consumer. Thus, it is not absolutely necessary to form a belt-like member 40 so that a gap is formed between the two end portions 42 and 43 of the belt-like member 40.

EXPLANATION OF REFERENCE NUMERALS

1 a beverage container
1*a* a beverage container mouth
1*b* a male screw portion
2 a cap
3 hydrogen encapsulating cap
10 a cylindrical cap body
11 a cylindrical body
12 a female screw portion
13 a downward movement regulating plate
14 a water-tight piece
15 a passage opening
16 a projection
20 a press member
21 a press member body
22 a side projection
23 an engaging portion
24 an inner rib
25 an upper surface of a press member
30 a hydrogen encapsulating bag
40 a belt-like member
41 a thinned portion
42, 43 an end portion of a belt-like member
50 an annular rib

The invention claimed is:

1. A hydrogen encapsulating cap for a beverage container comprising:
- a cylindrical cap body provided with a female screw portion fitted onto a male screw portion of a beverage container mouth;
- a hydrogen encapsulating bag accommodated in the cylindrical cap body;
- a press member for pushing the hydrogen encapsulating bag from above;
- a downward movement regulating plate is provided at a lower portion of the cylindrical cap body and above the female screw portion;
- wherein the downward movement regulating plate is provided with a watertight piece in contact with an upper end surface of the beverage container mouth; and
- a passage opening through which hydrogen released from the hydrogen encapsulating bag can pass.

2. A hydrogen encapsulating cap for a beverage container in accordance with claim 1, wherein the passage opening is provided at a center portion of the downward movement regulating plate and the downward movement regulating plate is disposed so as to be sloped downwardly toward the passage opening.

3. A hydrogen encapsulating cap for a beverage container in accordance with claim 1 or 2, wherein an upper surface of the downward movement regulating plate is formed with projections which can penetrate through a wall of the hydrogen encapsulating bag.

4. A hydrogen encapsulating cap for a beverage container in accordance with claim 1 or 2, which further comprises:
- inner ribs formed on an outer circumferential surface of the press member so as to be concentric therewith; and
- wherein each of the inner ribs is formed with a projection which is directed downwardly and can penetrate through a wall of the hydrogen encapsulating bag.

5. A hydrogen encapsulating cap for a beverage container in accordance with any one of claim 1 or 2, which further comprises:
- a belt-like member which is connected to the upper end portion of the cylindrical cap body and covers the outer surface of the press member; and
- wherein a portion connecting the belt-like member and the upper end portion of the cylindrical cap body has a strength lower than that of other portions of the hydrogen encapsulating cap for the beverage container.

6. A hydrogen encapsulating cap for a beverage container in accordance with claim 5, wherein the portion connecting the belt-like member and the upper end portion of the cylindrical cap body is constituted by a thinned wall member.

7. A hydrogen encapsulating cap for a beverage container in accordance with claim 3, which further comprises:
- a belt-like member which is connected to the upper end portion of the cylindrical cap body and covers the outer surface of the press member; and wherein a portion connecting the belt-like member and the upper end portion of the cylindrical cap body has a strength lower than that of other portions of the hydrogen encapsulating cap for the beverage container.

8. A hydrogen encapsulating cap for a beverage container in accordance with claim 4, which further comprises:

a belt-like member which is connected to the upper end portion of the cylindrical cap body and covers the outer surface of the press member; and wherein a portion connecting the belt-like member and the upper end portion of the cylindrical cap body has a strength lower than that of other portions of the hydrogen encapsulating cap for the beverage container.

9. A hydrogen encapsulating cap for a beverage container in accordance with any one of claim 1 or 2, wherein the portion connecting the belt-like member and the upper end portion of the cylindrical cap body is constituted by a thinned wall member.

10. A hydrogen encapsulating cap for a beverage container in accordance with claim 3, wherein the portion connecting the belt-like member and the upper end portion of the cylindrical cap body is constituted by a thinned wall member.

11. A hydrogen encapsulating cap for a beverage container in accordance with claim 4, wherein the portion connecting the belt-like member and the upper end portion of the cylindrical cap body is constituted by a thinned wall member.

* * * * *